US005747428A

United States Patent [19]

Khorramian

[11] Patent Number: 5,747,428

[45] Date of Patent: May 5, 1998

[54] SOLID LUBRICANT FOR LOW AND HIGH TEMPERATURE APPLICATIONS

[76] Inventor: Behrooz A. Khorramian, 130 Woodridge Pl., Leonia, N.J. 07605-1625

[21] Appl. No.: 812,672

[22] Filed: Mar. 10, 1997

[51] Int. Cl.[6] ..... C10M 13/00

[52] U.S. Cl. ..... 508/151; 508/161; 508/166; 508/167; 508/169

[58] Field of Search ..... 508/103, 108, 508/150, 167, 169, 151, 161, 166; 106/286.1, 286.8, 287.1, 287.18; 428/698

[56] References Cited

U.S. PATENT DOCUMENTS

| | | | |
|---|---|---|---|
| 4,647,386 | 3/1987 | Jamison | 508/150 |
| 4,756,841 | 7/1988 | Buran et al. | 508/150 |
| 5,282,985 | 2/1994 | Zabinski et al. | 508/169 |

FOREIGN PATENT DOCUMENTS 4414051 7/1995 Germany .

OTHER PUBLICATIONS

Low Friction Composite Coating of Chromium Silicide/Molybdenum. Werkstofforsch. Dresden Surf. Coat. Technol. 60(1–3), 515–20, 1993.

*Primary Examiner*—Jacqueline V. Howard
*Assistant Examiner*—Cephia D. Toomer

[57] ABSTRACT

A self-lubricating solid coating that contains three layers of lubricants is disclosed. The solid lubricant may be prepared from chromium silicide or chromium carbide; disulfide and diselenide of tungsten, molybdenum, niobium, or tantalum; and silver or gold. This material combination provides superior wear and friction reduction over the temperature range applied. In this invention, chromium silicide or chromium carbide is a hard lubricant with a low wear property to protect the substrate metal; disulfide or diselenide is a soft lubricant with a very low coefficient of friction; and silver or gold with their high thermal conductivity are effective in conducting heat especially at high sliding velocities. Both silver and gold have a low friction coefficient with high oxidative stability. The use of this solid lubricant allows engine manufacturers to develop high temperature engine and partially or totally eliminate the use of liquid lubricants in engines, thus reducing the environmental pollution caused by liquid lubricants in various engines.

11 Claims, No Drawings

SOLID LUBRICANT FOR LOW AND HIGH TEMPERATURE APPLICATIONS

The present invention relates to a self-lubricating solid coating for engine components operating from −60° C. to 650° C. This solid lubricant is made of a three-layer coating consisting of chromium silicide or chromium carbide, disulfide or diselenide of tungsten, niobium, molybdenum or tantalum, and silver or gold. This solid lubricant provides remarkable wear and friction reduction within the above specified temperature range. This technology will enable the designers to develop advanced high power, high temperature automotive, turbo, and gas turbine engines, while reducing energy consumption and air pollution by eliminating the use of toxic metals in the design of the engine components. The use of this solid lubricant will partially or totally replace the liquid lubricants currently used in engines and provide an environmentally benign lubricant by reducing the generation of toxic gases and the release of chemicals into the atmosphere.

BACKGROUND OF THE INVENTION

The current invention includes a solid lubricant made of three layers of lubricants with low wear and friction coefficient suitable for low and high temperature applications in various engines including automobile, gas turbine and turbo engines. In general, lubricants perform a variety of functions in engine applications. One of the most important functions is to reduce wear and friction in moving machinery. Also, lubricants protect the substrate metals against wear, oxidation, and corrosion.

Advanced engines such as low heat rejection (adiabatic) and gas turbine engines demand much higher temperature stability from lubricants than the stability provided by current lubricant oils. The introduction of alternative fuels such as alcohol, natural gas, and others also cause many unforeseen problems such as the extraction of lubricant additives from the lubricant oil, which leads to increased wear in diesel injectors, cams, valves, and lifters. To deal with this problem and many other environmental, energy, and efficiency issues, engine designers are developing engines with high power density, improved durability, fuel economy, reduced emissions, alternative fuels, manufacturability, recycling, low cost materials and design, and the use of light weight materials. High power density requires greater performance in a smaller and lighter engine. This, in turn, requires higher service from the lubricant. Improved durability, on the other hand, requires longer service lives for engine components, reduced failures, and less frequent maintenance intervals for the engine in spite of the increased temperatures, pressures, and speeds. Thus, engine components have to be better protected and lubricated as servicing conditions become more severe.

To comply with the above requirements, engine designers need high strength materials such as ceramic, ceramic coatings, and composites (both metal and ceramic-matrix composites). In recent years, tremendous strides have been made in making ceramics stronger, tougher, and more reliable. The unique high temperature strength of ceramics makes higher combustion temperatures possible so that the potential amount of energy that can be recovered is larger, thereby increasing energy efficiency. Ceramics can be used for critical applications like valves, cam followers, turbocharger rotors, tappets, and rolling contact bearings to assure longer wear lives at higher temperatures. Also, ceramics can be used in the construction of piston/cylinder liner interface to eliminate problems associated with the severe conditions of low heat rejection engines. If the heat rejection rate of a low heat rejection car engine decreases from 21 BTU/HP/mMin. to 12 BTU/HP/mMin., the top ring reversal temperature will increase to as high as 649° C. Liquid lubricants cannot withstand this temperature. Also, some conventional materials such as lead, with a melting point of 328° C., and antimony, with a melting point of 631° C., cannot survive this temperature. In addition, lead and antimony which are used in lead-base babbitts are toxic and impose difficulty in recycling.

Another safety aspect of the lubricant, for example in aviation applications, is its performance reliability. All the components and systems in aircraft which are critical for safe operation involve lubrication. A survey of over 900 aircraft accidents in the United Kingdom between 1984 and 1988 showed that nine were directly related to bearing failures. One of these was initially caused by galling and one by excessive wear, both caused because of lubrication failure.

Among factors which contribute to the effectiveness of a lubricant in engine applications is high temperature antiwear property, which reduces metal-to-metal contact in moving machinery. With an effective antiwear additive, metal scoring, welding, and metal wear can be prevented.

The prior art discloses the use of chromium silicide/molybdenum sulfide by D. Kraut and G. Weise, entitled "Low Friction Composite Coating of $Cr_xSi_y/MoS_2$ on Steel" published in Surface and Coating Technology, 60, 515–520 (1993). There is no teaching or suggestion in this publication that discrete layers of chromium silicide and $MoS_2$ should be used, nor is there a disclosure that an inert, protective overlayer of a noble metal such as silver or gold also be employed. The use of an inert overlayer can protect the lubricant against corrosion, oxidation, and chemical attack. This is essential to maintain the integrity of the solid lubricant under various chemical conditions for a reliable performance.

Another prior art by H. E. Sliney, published in ASLE Transactions, 29, 370–376 (1985), entitled "The Use of Silver in Self-Lubricating Coatings for Extreme Temperatures" discloses composite coatings of $MoS_2$ and $BaF_2$—$CaF_2$ eutectic with silver and chromium carbide. While this publication discloses a composite of $MoS_2$ and silver, it is not applied as an overlayer on chromium carbide. When silver is used in combination with chromium carbide, it is in a composite coating, rather than as an overlayer.

A problem with prior art solid lubricant compositions is that they might not have considered all the attributes of the present invention, namely, low wear, low friction, low and high temperature applications (−60° to 650° C.), resistance against corrosion, oxidation, and chemical attacks, high thermal conductivity, and environmental safety.

The solid lubricant of this invention was developed to operate at extreme temperatures, where liquid lubricants cannot withstand engine conditions. By replacing the liquid lubricants, it eliminates the release of chemicals and the generation of toxic chemicals by liquid lubricants into the surroundings. Thus, this lubricant not only provides wear, oxidation and corrosion protection with reduced friction for engine components, but also is in compliance with environmental safety regulations.

SUMMARY OF THE INVENTION

It is an object of this invention to provide a solid lubricant coating for engine components that withstand low and high temperature operation conditions.

After object of this invention is to provide a solid lubricant coating for engine components that withstand engine operation temperature as low as −60° C. and as high as 650° C.

A further object of this invention is to provide a solid lubricant coating for engine components that effectively reduces wear and friction in engine components.

A further object of this invention is to provide a solid lubricant coating for engine components that protect the engine components against chemical attacks such as corrosion and oxidations.

A further object of this invention is to provide a solid lubricant coating for engine components that does not contain any toxic or hazardous substances.

Additional objects and advantages of the invention will be set forth in part, in the discussion that follows, and in part will be obvious from the description, or may be learned by the practice of the invention. The objects and advantages of the invention will be attained by means of the instrumentalities and combinations particularly pointed out in the appended claims.

To achieve the objects and in accordance with the purpose of the invention, as embodied and broadly described herein, the present invention provides for solid lubricant coating for engine components such as aircraft and turbo engines, automobile engine components, and components of spacecraft that either operated at very low and high temperatures or need to operate in an environment with reduced chemical contaminant in the surrounding. The solid lubricant of this invention is made of hard lubricant of chromium silicide or chromium carbide layer, which is deposited directly on the substrate metal that is the main constituent of the engine or engine components. The method of deposition can be any suitable coating process, namely, RF magnetron sputtering, plasma spraying deposition, or chemical vapor deposition. A second layer of the solid lubricant is a soft lubricant layer of a disulfide or diselenide of tungsten, niobium, molybdenum, or tantalum which is deposited directly on the chromium silicide or chromium carbide layer. Again, RF magnetron sputtering, plasma spraying deposition, or chemical vapor deposition can be used to deposit the soft lubricant. A third layer of the solid lubricant of this invention is noble metal lubricant or silver or gold, which is deposited on the soft lubricant layer. To reduce the thermal stress between the noble metal layer and the soft lubricant layer due to the difference between their coefficient of thermal expansions, a very small layer of titanium or chromium is deposited on the soft lubricant layer prior to depositing the noble metal lubricant. Both noble metal lubricant and titanium or chromium can be deposited using DC magnetron sputtering, plasma spraying deposition, or chemical vapor deposition.

DETAILED DESCRIPTION OF THE INVENTION

Reference will now be made in detail to the presently preferred embodiments of the invention, which, together with the following examples, serve to explain the principles of the invention.

The present invention provides a solid lubricant that can be coated on engine components to provide lubricity, wear, corrosion and oxidation protection. In this invention, we designed a self-lubricating composite coating made of ceramic lubricants and noble metal for low and high temperature applications. This material provides excellent wear protection and friction reduction for the temperature range of −60° C. to 650° C. Among the ceramics, chromium silicide and chromium carbide are ideal materials with chromium silicide being the preferred hard lubricant.

Chromium silicide can have a chemical structure of $Cr_3Si$, $CrSi_2$, CrSi, $Cr_3Si_2$, or any combinations of $Cr_3Si$ and $CrSi_2$. This material is a hard lubricant with good adhesion on substrate metal, such as steel. It can be coated on the substrate metal by sputtering, chemical vapor deposition, or plasma spray deposition. Its thickness can vary from 0.1 to 700 micrometer (micron). The preferred thickness will range from 0.2 to 70 micrometers. As a hard coating, chromium silicide exhibited relatively good wear protection with relatively lower friction coefficient specially at temperatures above 0° C. As shown in TABLE 1, using a pin-on-disk tester, the friction coefficient and wear rate of steel 440C (a constituent of some engine components) at 25° C. were 0.6 and $3.3\times10^{-4}$, respectively. The friction coefficient and wear rate of chromium silicide at 25° C. were 0.4 and $0.7\times10^{-4}$ mm/Nm, respectively, a 33% reduction in friction coefficient and a 79% reduction in wear rate over steel 440C. At 400° C., the friction coefficient and wear rate reduction over steel 440C were 78% and 10%, respectively.

The dual features of chromium silicide made it an ideal intermediate coating between the metal substrate and the tungsten disulfide soft self-lubricant layer. As an intermediate hard lubricant, chromium silicide provided much higher endurance lives to lubricants deposited on it than lubricants deposited directly on the metal substrate. For example, the endurance life of a 0.1 micron-thick $WS_2$ lubricated ball bearing without an intermediate chromium silicide layer is about 200 hours. With a 0.1 micron intermediate coating of chromium silicide, the endurance life of the same $WS_2$ exceeds 1000 hours. Several deposition techniques can be used to deposit

TABLE 1

The Effects of Temperature on the Tribology of Various Layers of Solid Lubricant of this Invention
Test conditions: Load = 5 N; Sliding speed = 0.2 m/s

| | Temperature | | | | | | | |
|---|---|---|---|---|---|---|---|---|
| | −60° C. | | 25° C. | | 200° C. | | 400° C. | |
| | Tribological Measurement | | | | | | | |
| | Wear Rate, $mm^3/Nm$ | Fric. Coef. | Wear Rate, $mm^3/Nm$ | Fric. Coef. | Wear Rate, $mm^3/Nm$ | Fric. Coef. | Wear Rate, $mm^3/Nm$ | Fric. Coef. |
| Uncoated Steel 440C | $3.2\times10^{-6}$ | 0.20 | $3.3\times10^{-4}$ | 0.60 | $5.1\times10^{-4}$ | 0.55 | $3.3\times10^{-4}$ | 0.50 |
| $Cr_3Si_2 + WS_2$ + Ag Coating | $2.1\times10^{-6}$ | 0.07 | $1.8\times10^{-6}$ | 0.05 | $<4\times10^{-9}$ | 0.015 | $8.6\times10^{-7}$ | 0.06 |
| $Cr_3Si_2 + WS_2$ Coating | $2.5\times10^{-6}$ | 0.07 | $1.3\times10^{-6}$ | 0.04 | $<5\times10^{-7}$ | 0.015 | $2.3\times10^{-5}$ | 0.06 |
| $Cr_3Si_2$ Coating | $2.9\times10^{-6}$ | 0.25 | $0.7\times10^{-4}$ | 0.60 | $1.5\times10^{-4}$ | 0.45 | $7.4\times10^{-5}$ | 0.45 |

chromium silicide. Among these techniques are RF magnetron sputtering, chemical vapor deposition, and plasma spray deposition.

The second layer of the solid lubricant of this invention is a soft lubricant made of a disulfide or diselenide of tungsten, niobium, molybdenum, niobium, or tantalum, which is coated on a hard lubricant of chromium silicide or chromium carbide. Again, RF magnetron sputtering, chemical vapor deposition, plasma spray deposition, or other deposition techniques can be used to deposit the soft lubricant. One of the preferred soft lubricant of this invention is tungsten disulfide ($WS_2$). It has one of the lowest friction coefficients among materials. It is also a widely used additive for liquid lubricants in automotive applications. At −60° C. and air it shows a coefficient friction and a wear rate of 0.07 and $2.5\times10^{-6}$ $mm^3/Nm$, respectively. It friction coefficient and wear rate gradually reduce to 0.015 and less than $5\times10^{-7}$ mm/Nm at 200° C., respectively. Its friction coefficient in air gradually increases with temperature to about 0.38° at 800° C. In an argon atmosphere, its friction coefficient remains under 0.1° up to 800° C. Its thickness in the solid lubricant can range from 0.0314 to 110 microns. The preferred thickness ranges from 0.1 to 11 microns.

Other materials can also be used in place of $WS_2$. Among these materials are lamellar compounds including molybdenum disulfide, niobium disulfide, tantalum disulfide, molybdenum diselenide, tungsten diselenide, niobium diselenide, and tantalum diselenide. Deposition of a soft lubricant on chromium silicide or chromium carbide hard lubricant would increase the endurance life of the soft lubricant.

Another lubricant which will be deposited on the soft lubricant surface by the sputtering method is silver or gold with silver being the preferred metal. Silver is a soft low friction noble metal with high oxidative stability. It provides a thin film lubrication with low shear strength. Silver has one of the highest thermal conductivity, lowest density, lowest hardness, and lowest price among the three known precious metals. It is highly effective in controlling wear at a high sliding velocity where frictional heat becomes pronounced. Silver can be deposited on tungsten disufide by DC magnetron sputtering, chemical vapor deposition, plasma spray deposition, or other deposition techniques. In spite of the silver higher friction coefficient and wear rate than disulfide or diselenide soft lubricant layers, a combination of its layer with the tungsten disulfide soft lubricant middle layer, and chromium silicide show a very low friction coefficient and wear rate. As shown in TABLE 1, the friction coefficient and wear rate of the three-layer coating ($Cr_3Si_2$+$WS_2$+Ag) were 0.07 and $2.1\times10^{-6}$ mm /Nm at −60° C., respectively. At 200° C., these values reduced to 0.015 and less than $4\times10^{-9}$ $mm^3/Nm$, respectively. At 400° C., the friction coefficient and chromium silicide were 0.06 and $8.6\times10^{-7}$ $mm^3/Nm$, respectively. By comparison the wear rate of the three-layer coating ($Cr_3Si_2$+$WS_2$+Ag) to that of two-layer coating ($Cr_3Si_2$+$WS_2$) at 400° C., it is evident that the wear rate decreased from $2.3\times10^{-5}$ to $8.6\times10^{-7}$ $mm^3/Nm$, a reduction of 27 times.

The thickness of silver in solid lubricant can vary from 0.023 to 80 microns with preferred range being from 0.1 to 8 microns. Other soft metals can be also used in place of silver. Among these metals are lead, gold, and indium. Among the noble metals, however, silver has the lowest density (10.5 $g/cm^3$), highest thermal conductivity (427 W/mK), lowest hardness (60 Knoop), lowest static friction (0.5), and the highest coefficient thermal expansion, TABLE 2.

Due to the large difference in the coefficient of thermal expansion between tungsten disulfide and silver, as shown in TABLE 3, a small layer of titanium is deposited between these two layers. The titanium layer is deposited directly onto tungsten disulfide prior to the deposition of silver on tungsten disulfide. DC magnetron sputtering, chemical vapor deposition, plasma spray deposition, or other deposition techniques can be used in depositing titanium on tungsten disulfide.

TABLE 4 shows a summary description of the solid lubricant of this invention.

There are two preferred embodiments of the solid lubricant of this invention. Each of the two embodiments first contain a layer of chromium silicide deposited directly on the substrate metal. The chromium silicide may have a thickness ranging from 0.2 to 700 micrometer with a preferred thickness ranging from 0.2 to 70 micrometers. Additionally, the first embodiment contains a layer of tungsten disulfide deposited directly onto chromium silicide. The tungsten disulfide layer may have a thickness ranging from 0.0314 to 110 micrometer with a preferred thickness ranging from 0.1 to 11 micrometers.

TABLE 2

Physical Data of Three Inert Metals

| Name | Density ($g/cm^3$) | Melting Point (°C.) | Thermal Conductivity (W/mK) | Hardness (Knoop) | Static Friction Coefficient | Coefficient of Thermal Expansion, ($K^{-1}$) at 500° C. |
|---|---|---|---|---|---|---|
| Silver | 10.5 | 961 | 429 | 60 | 0.50 | $23.6\times10^{-6}$ |
| Gold | 19.3 | 1065 | 317 | 120 | 0.53 | $16.9\times10^{-6}$ |
| Platinum | 21.4 | 1772 | 72 | 170 | 0.64 | $10.2\times10^{-6}$ |

TABLE 3

Physical Data of Three Components of the Solid Lubricant

| Name | Chemical Formula | Thermal Conductivity (W/mK) | Density ($g/cm^3$) | Melting Point (°C.) | Hardness (Knoop) | Coefficient of Thermal Expansion, ($K^{-1}$) at 500° C. |
|---|---|---|---|---|---|---|
| Chromium silicide | $Cr_3Si_2$ | 25 | 5.5 | d 1950 | 805 | $10.6\times10^{-6}$ |
| Tungsten disulfide | $WS_2$ | 33 | 7.5 | d 1250 | ~30 | $10.6\times10^{-6}$ |
| Silver | Ag | 427 | 10.5 | 961 | 60 | $23.6\times10^{-6}$ |

The second preferred embodiment of the solid lubricant of this invention in addition to two layers of lubricants of first embodiment contains a small layer of titanium deposited on tungsten disulfide and a layer of silver deposited on titanium. The thickness of titanium layer ranges from 10 to 1000 angstroms with a preferred thickness of 100 to 500 angstroms. The silver layer may have a thickness of 0.023 to 80 micrometers with a preferred range of 0.1 to 8 micrometers.

TABLE 4

A Summary Description of the Characteristics and Functions of each Material in the Proposed Self-Lubricating Coating for Advanced Gas Turbine Engines

UPPER LAYER: SILVER COATING

Characteristics:
1. Noble metal
2. Low coefficient of friction (about 0.11)
3. Oxidative and chemical resistance
4. Oxidation and chemical protection for tungsten disulfide
5. Typical thickness of 0.1 to 8 micrometers
6. Deposited onto the soft lubricant layer

MIDDLE LAYER: TUNGSTEN DISULFIDE

Characteristics:
1. Soft lubricant
2. Layered (lamella) structure

TABLE 4-continued

A Summary Description of the Characteristics and Functions of each Material in the Proposed Self-Lubricating Coating for Advanced Gas Turbine Engines 3. Very low friction of coefficient (about 0.07 or less)
4. Higher hardness and oxidative resistance than $MoS_2$
5. Typical thickness of 0.1 to 11 micrometers
6. Deposited onto the hard lubricant layer

BOTTOM LAYER: CHROMIUM SILICIDE

Characteristics:
1. Hard lubricant
2. Wear protection for the substrate
3. Back up lubricity when the soft lubricant is worn out
4. Increasing the life of the soft lubricant
5. Typical thickness of 0.2 to 70 micrometers
6. Deposited directly onto the substrate material It is to be understood that the application of the teachings of the present invention to a specific problem will be within the capabilities of one having ordinary skill in the art in light of the teachings contained herein. Examples of the products of the present invention and processes of their preparation and for their use appear in the following examples.

EXAMPLES

Example 1

EXAMPLE 1 is based on the first embodiment of this invention. The constituents of EXAMPLE 1 is shown in TABLE 5. Its tribological characteristics were compared to those of steel 440C and is shown in TABLE 6.

TABLE 5

EXAMPLE 1 Based on Embodiment 1

| Component | Component Volume % | Component Weight % | Composition | Composition Weight % | Thickness, μm |
|---|---|---|---|---|---|
| $Cr_3Si_2$ | 79 | 70 | Cr | 51 | 2.0 |
| | | | Si | 19 | |
| $WS_2$ | 12 | 15 | W | 11 | 0.314 |
| | | | S | 4 | |

TABLE 6

The Effects of Temperature on the Tribology of Example 1 of the First Solid Lubricant Embodiment of this Invention
Test conditions: Load = 5 N; Sliding speed = 0.2 m/s

| | Temperature | | | | | | | |
|---|---|---|---|---|---|---|---|---|
| | −60° C. | | 25° C. | | 200° C. | | 400° C. | |
| | Tribological Measurement | | | | | | | |
| | Wear Rate, $mm^3/Nm$ | Fric. Coef. | Wear Rate, $mm^3/Nm$ | Fric. Coef. | Wear Rate, $mm^3/Nm$ | Fric. Coef. | Wear Rate, $mm^3/Nm$ | Fric. Coef. |
| Uncoated Steel 440C | $3.2 \times 10^{-6}$ | 0.20 | $3.3 \times 10^{-4}$ | 0.60 | $5.1 \times 10^{-4}$ | 0.55 | $3.3 \times 10^{-4}$ | 0.50 |
| $Cr_3Si_2 + WS_2$ Coating | $2.5 \times 10^{-6}$ | 0.07 | $1.3 \times 10^{-6}$ | 0.04 | $<5 \times 10^{-7}$ | 0.015 | $2.3 \times 10^{-5}$ | 0.06 |

The reduction (or improvement) of friction coefficient over the substrate metal ranges from 88% at 400° C. to 97% at 200° C. The wear volume reduction (or improvement) in those temperatures ranges from 22% to more than three order of magnitude or more than 1000 times.

Example 2

EXAMPLE 2 is based on the second embodiment of this invention. The constituents of EXAMPLE 2 are shown in TABLE 7. Its tribological characteristics were compared to those of steel 440C and are shown in TABLE 8.

TABLE 7

EXAMPLE 2 Based on Embodiment 2

| Component | Component Volume % | Component Weight % | Composition | Composition Weight % | Thickness, μm |
|---|---|---|---|---|---|
| $Cr_3Si_2$ | 79 | 70 | Cr | 51 | 2.0 |
| | | | Si | 19 | |
| $WS_2$ | 12 | 15 | W | 11 | 0.314 |
| | | | S | 4 | |
| Ag | 9 | 15 | Ag | 15 | 0.23 |

The reduction (or improvement) of friction coefficient of the EXAMPLE 2 over the substrate metal ranges from 88% at 400° C. to 97% at 200° C. The wear volume reduction (or improvement) in those temperatures ranges from 34% to more than five order of magnitude or more than 100,000 times.

TABLE 8

The Effects of Temperature on the Tribology of EXAMPLE 2 of the Second Solid Lubricant Embodiment of this Invention
Test conditions: Load = 5 N; Sliding speed = 0.2 m/s

| | Temperature | | | | | | | |
|---|---|---|---|---|---|---|---|---|
| | −60° C. | | 25° C. | | 200° C. | | 400° C. | |
| | Tribological Measurement | | | | | | | |
| | Wear Rate, $mm^3/Nm$ | Fric. Coef. | Wear Rate, $mm^3/Nm$ | Fric. Coef. | Wear Rate, $mm^3/Nm$ | Fric. Coef. | Wear Rate, $mm^3/Nm$ | Fric. Coef. |
| Uncoated Steel 440C | $3.2 \times 10^{-6}$ | 0.20 | $3.3 \times 10^{-4}$ | 0.60 | $5.1 \times 10^{-4}$ | 0.55 | $3.3 \times 10^{-4}$ | 0.50 |
| $Cr_3Si_2 + WS_2 +$ Ag Coating | $2.1 \times 10^{-6}$ | 0.07 | $1.8 \times 10^{-6}$ | 0.05 | $<4 \times 10^{-9}$ | 0.015 | $8.6 \times 10^{-7}$ | 0.06 |

What is claimed:

1. A dry, solid multi-component lubricant coating deposited on the surface of substrate material thereof, said multi-component coating comprising:

a first layer of chromium silicide or chromium carbide deposited on said substrate; and a second layer of soft lubricant selected from the group consisting of tungsten disulfide, niobium disulfide, molybdenum disulfide, tantalum disulfide, tungsten diselenide, niobium diselenide, molybdenum diselenide, and tantalum diselenide deposited on said chromium silicide or chromium carbide a third layer which is a noble metal deposited on the said second layer.

2. The solid lubricant of claim 1 wherein said first layer is a combination of $Cr_3Si$, $CrSi_2$, and CrSi.

3. The solid lubricant of claim 2 wherein said first layer further comprises $Cr_3Si_2$.

4. The solid lubricant of claim 1 wherein said first layer has a thickness in the range of 0.2 to 70 micormeters.

5. The solid lubricant of claim 1 wherein said first layer comprises $Cr_3C_2$.

6. The solid lubricant of claim 1 wherein said second layer comprises tungsten disulfide having a thickness in the range of 0.1 to 11 micrometers.

7. The solid lubricant of claim 1 wherein said second layer comprises molybdenum disulfide or tungsten disulfide having a thickness in the range of 0.1 to 11 micrometers.

8. The solid lubricant of claim 1 wherein said noble metal layer comprises silver having a thickness in the range of 0.1 to 8 micrometers.

9. The solid lubricant of claim 1 wherein said noble metal layer comprises gold having a thickness in the range of 0.1 to 8 micrometers.

10. The solid lubricant of claim 8 comprising a silver metal layer, a tungsten disulfide second layer, and a chromium silicide first layer.

11. The solid lubricant of claim 1 wherein said second layer comprises tungsten disulfide and said first layer comprises chromium silicide.

* * * * *